US010519391B2

(12) United States Patent
Bush

(10) Patent No.: US 10,519,391 B2
(45) Date of Patent: Dec. 31, 2019

(54) GUN LUBRICANT

(71) Applicant: Dane Bush, Jamestown, NY (US)

(72) Inventor: Dane Bush, Jamestown, NY (US)

( * ) Notice: Subject to any disclaimer, the term of this patent is extended or adjusted under 35 U.S.C. 154(b) by 23 days.

(21) Appl. No.: 15/679,834

(22) Filed: Aug. 17, 2017

(65) Prior Publication Data

US 2019/0055489 A1 Feb. 21, 2019

(51) Int. Cl.
*C10M 105/36* (2006.01)
*C10M 169/04* (2006.01)

(52) U.S. Cl.
CPC ..... *C10M 105/36* (2013.01); *C10M 169/04* (2013.01); *C10M 2207/2825* (2013.01); *C10M 2207/301* (2013.01); *C10N 2230/02* (2013.01); *C10N 2240/10* (2013.01)

(58) Field of Classification Search
CPC ..... C10M 105/36; C10M 169/04; C10M 2207/2825; C10M 2207/301; C10N 2240/10; C10N 2230/02
See application file for complete search history.

(56) References Cited

U.S. PATENT DOCUMENTS 4,243,537 A 1/1981 Knepp et al.
4,333,840 A 6/1982 Reick
6,737,388 B2 5/2004 Shepherd
2,397,904 A1 5/2015 Harunobu Matsui et al.
9,222,050 B1 12/2015 Simonetti
9,637,705 B1 * 5/2017 Waldron ..... C10M 111/02
2005/0256014 A1 * 11/2005 Sherman ..... C08G 65/2609 508/579
2006/0194701 A1 * 8/2006 Gibbons ..... C10M 169/044 508/208
2010/0120643 A1 * 5/2010 Brown ..... C10M 105/38 508/496
2011/0136714 A1 6/2011 Haigh
2014/0082986 A1 3/2014 Gay
2015/0252284 A1 * 9/2015 Waldron ..... C10M 169/042 42/96
2019/0225910 A1 * 7/2019 Waldron ..... C10M 169/04

FOREIGN PATENT DOCUMENTS

EP 0712925 A3 7/1996

OTHER PUBLICATIONS

"More Than You Ever Wanted to Know About Motor Oil" by Ed Hackett (Jul. 11, 1999).*

* cited by examiner

*Primary Examiner* — Pamela H Weiss
(74) *Attorney, Agent, or Firm* — Vincent G. LoTempio; Kloss, Stenger & LoTemptio; David T. Stephenson

(57) ABSTRACT

A lubricant for a gun or other metal devices, including a composition and method of treating a gun to maintain optimum operative condition. The lubricant serves many purposes, beyond simply allowing parts to move with less resistance. In addition to reducing friction between moving parts of the gun, the gun oil of the present disclosure disperses to coat the metal parts of the gun thoroughly and evenly, remains moist for an extended period of time, and when dry, forms a thick layer that protects the metal components of the gun from wear and rust. The lubricant includes a 4-cycle synthetic motor oil, an oil stabilizer, and a 2-cycle motor oil.

10 Claims, No Drawings

GUN LUBRICANT

BACKGROUND

The present disclosure relates to a lubricant for a gun or other metal devices. The present disclosure further relates to an improved gun oil lubricant and a method of treating a gun to maintain that mechanism in optimum operative condition. A gun lubricant serves many purposes, beyond simply allowing parts to move with less resistance. In addition to reducing friction between moving parts of the gun, effective gun oil should disperse to coat the metal parts of the gun thoroughly and evenly, remain moist for an extended period of time, and when dry, form a thick layer that protects the metal components of the gun from wear and rust. Higher viscosity is therefore a desirable quality in gun oil.

Increased efficiency of use, in terms of quantity of amount of oil necessary to fully coat the gun and perform the function listed above is also desirable, in terms of reduced time of application and reduced cost of material.

With particular regard to gun oils, flash point of the oil is a critical consideration. The flash point of a volatile material, such as gun oil, is the lowest temperature at which vapors of the material will ignite, when given an ignition source. With regard to the firing of a gun, the ignition source is the explosion that takes place when the hammer contacts the ammunition. Therefore, gun oil is necessarily subjected to an ignition source. Depending on the type of gun and ammunition, the ignition source may have a higher or lower temperature. Certain types of guns, particularly high-powered automatic weapons, reach temperatures above the flash point of conventional gun oils.

Conventional gun oil lubricants may comprise a combination of additives and base oil. However, conventional gun oils are inferior with regard to protection of gun metal, flash point and other desirable characteristics of gun oil. Petroleum based oils have desirable properties such as high flash points and low freeze points, however, petroleum based oils are not viscous enough to be effective as a gun oil and were runny.

Therefore, there is a need for a gun oil lubricant that has a long lasting protective effect, disperses quickly and evenly, and has a high flash point to accommodate many modern firearms.

SUMMARY

A goal of the present disclosure is to provide a new formulation for a combination of base oil and additives for gun oil that effectively lubricates the gun, while also providing a high flash point to accommodate high-powered modern firearms. The lubricant of the present disclosure forms a thicker viscosity than comparable, conventional oils such as those manufactured by Hopson™, Rem™ and CLP™.

The gun oil of the present disclosure has the benefits of petroleum based gun oils without the negative properties associated therewith.

According to a preferred embodiment of the present disclosure, Mobil™ super synthetic 10w-30 combined with LucasTM heavy duty oil stabilizer and Stihl™ HP Ultra in particular proportions generates an ideal gun oil that maintains viscosity and lubrication significantly better than other products currently available. 70% Mobil 1 Super Synthetic™ which is relatively thin motor oil, may be used in a preferred embodiment.

18% heavy duty oil stabilizer, a multi-use oil supplement, is a component of the present disclosure. A 2-cycle oil, in the preferred embodiment 12% Stihl™ 2- cycle HP oil (Ultra) is used. Stihl™ Ultra is a high detergency 2-cycle engine oil. With regard to a difference between standard lubricating oil and two-stroke oil, a relevant difference is that two-stroke oil has lower ash content. The lower ash content minimizes deposits that may form if ash is present in the oil which is burned in the engine's combustion chamber. Another important factor is that 4-stroke engines have a different requirement for 'stickiness' than do 2-stroke oils. Additives for two-stroke oils fall into several general categories: detergent/dispersants, anti-wear agents, biodegradability components and antioxidants (zinc compounds).

The gun oil lubricant of the present disclosure is configured to coat the metal surfaces and joints of the gun more uniformly and with greater viscosity and slickness than any gun oil known in the art. The lubricant is efficient, requiring about 2 drops to oil the entirety of a large firearm. When the lubricant dries, it leaves a protective layer, which is thicker than conventional gun oils and prevents rust. The lubricant also remains moist longer than conventional gun oils. The lubricant of the present disclosure has a higher flash point, approximately between 430° F. and 500° F., which is higher than comparable products. The higher flash point can be useful for lubricating fully automatic firearms. The lubricant also forms a higher viscosity than comparable oils such as Hopson rem oil and CLP.

It is a further aim of the present disclosure to provide a gun oil lubricant that will prevent corrosion, when compared to conventional and comparable gun oils and will minimize wear and tear on a gun, and maintain excellent levels of cleanliness, whilst lubricating uniformly and cleanly.

It is a further aim of the present disclosure that the components of the gun oil are not hazardous under the standards of the Occupational Safety and Health Administration (OSHA).

DETAILED DESCRIPTION

The gun oil of the present disclosure adheres to gun metal, rather than running when applied. The gun oil of the present disclosure also maintains great lubricity and high viscosity, along with a high flash point and low freeze point.

The formulation of the present disclosure consists of a series of components that when combined together, in particular quantities, and blended with a base of motor oil unexpectedly provides superior gun oil properties. The formulation of the present disclosure provides improved performance over existing gun oil lubricants. The lubricant of the present disclosure is also effective as a lubricant for locks, hinges and other mechanisms requiring lubrication.

In an effort to improve upon conventional gun oils, testing on gun oils was performed with conventional motor oils. Testing started with numerous different oils ranging from 0w-50 to 20w-50 grade oils as well as full synthetic oils. Certain conventional oils tested did not have desirable viscosity and lubricity characteristics, while others had a strong, unpleasant odor.

A super synthetic 10w-30 combined with Lucas™ heavy duty oil stabilizer and Stihl™ HP Ultra, in certain proportions, generates an ideal gun oil; having appropriate viscosity and lubricity, as well as being substantially odor-free. All three types of components are necessary for the present disclosure.

The invention will now be described with reference to the following examples:

EXAMPLES 32 oz synthetic motor oil, Mobil 1 Super Synthetic in the preferred embodiment, (Castrol fully synthetic, valvoline full synthetic, Pennzoil platinum full synthetic, Quaker state full synthetic were also tested) was combined with 6-10 oz. of oil stabilizer (Lucas Heavy Duty Oil StabilizerTM) and 3.2-8 amount of Stihl 2-cycle motor oil. Stihl oil has the advantage of providing cleaning properties and color. The Stihl oil provides the intended color and builds up layers on metal running surfaces of the firearms and helps prevents surface to surface wear and breakdown. Additionally, the Stihl component helps to remove rust.

After testing, generally, synthetic motor oil when combined with heavy duty oil stabilizer in appropriate amounts achieve the results of the present disclosure, while the preferred embodiment including the components listed above being most effective. For each test, either two or three drops was added to each subject gun (equal amounts for each gun) and distributed evenly.

Table 1 shows a preferred embodiment of the present disclosure.

TABLE 1

| | Type | Preferred Brand | Preferred Amt. (vol. %) | Range (vol. %) |
|---|---|---|---|---|
| Component A | 10W-30 synthetic motor oil | Mobil Super Synthetic ™ | 70% | 50%-70% |
| Component B | Oil stabilizer | Lucas Heavy Duty Oil Stabilizer ™ | 18% | 13.5%-28.0% |
| Component C | Synthetic 2-cycle engine oil | Stihl HP Ultra ™ | 12% | 8.0%-22.0% |

Example 1

Example 1 shows the range of components for effective use of The Product of the present disclosure. 32 oz. Mobil Super Synthetic™10W-30 motor oil (Component A), was combined with varying amounts of Lucas Heavy Duty Oil Stabilizer™ (Component B) and Stihl HP Ultra™ (Component C). Greater than 10 oz. Component B and less than 6 oz. Component B was tested.

Component A may preferably be a motor oil, and more preferably may be a 4-cycle motor oil, and more preferably may be a synthetic motor oil, and more preferably be a synthetic 10W-30 motor oil. Component A may have a flash point of 486° F. and a pour point of −39° F. Component A may have a viscosity-kinematic (cSt(mm2/s) at 40° C. of approximately 64.4 and a viscosity-kinematic (cSt(mm2/s) at 100° C. of approximately 10.5. Component A may preferably be selected from the group of motor oils consisting of the brand names of Castrol™ Fully Synthetic, Valvoline™ Fully Synthetic, Pennzoil™ Platinum Fully Synthetic, Mobil™ 1 Super Synthetic, and Quaker State™ Fully Synthetic.

Component B may be an oil stabilizer. Component B may preferably have an ingredients including lubricating oils, petroleum, c>25, hydrotreated bright stock-based, at 60-100%; having a CAS number 72623-83-7. Component B may contain an oil thickener and/or an oil tackifier and/or an oil tackifier polymer. Component B may have a flash point (closed cup) of 218.33° C. (425° F.). Component B may have a viscosity- kinematic at 100° C. (212° F.) of 1.1 cm2/s (110 cSt). Component B may more preferably be Lucas Heavy Duty Oil Stabilizer™ Component B may also be Morey's Heavy Duty Oil Stabilizer™.

Component C may be 2-cycle motor oil, and more preferably a Synthetic 2-cycle motor oil. Component C may have a base oil of trimethylopropane complex ester with a weight between 80-100%. Component C may have a flash point of approximately 428° F. and a pour point of approximately −38.2° F. Component C may have a viscosity-kinematic (cSt(mm2/s) at 40° C. of between 46.0 and 52.0 and a viscosity-kinematic (cSt(mm2/s) at 100° C. of between 7.9 to 8.9. Component C may more preferably be Stihl™ HP Ultra™ synthetic 2-cycle motor oil.

Results

When component B was added in an amount of less than 6 oz, too much flow of The Product resulted. When component B was added in an amount above 10z, Component A became too sticky for effective use as gun oil, such that it was similar to grease in viscosity. Greater than 10 oz. of Component B created a Product that was too thick, caused malfunctions, and would allow dirt, debris and lint to stick to a firearm. The preferred amount of Component B was 8 oz., and between 6 oz. and 10 oz. was effective. Therefore, between 6-10 oz. of Component B per 32 oz. of Component A was effective.

Comparative Testing

Table 2 shows a list of comparable and competing products with regard to the lubricant of the present disclosure.

TABLE 2

| | Brand |
|---|---|
| Lubricant A | The Product |
| Lubricant B | Hoppes 9 ™ |
| Lubricant C | Rem Oil ™ |
| Lubricant D | Amsoil Gun Lube ™ |
| Lubricant E | CLP ™ |
| Lubricant F | Lucas Gun Oil ™ |

Example 2

Viscosity Test

Viscosity was measured by comparison in performance between competing products. Viscosity was measured by properties including runniness on a scale of 1 to 10, where a 1 has viscosity properties similar to water and a 10 has properties similar to grease.

TABLE 3

| | Performance | Description |
|---|---|---|
| Lubricant A | 7 | Sticky and held position on the gun |
| Lubricant B | 2.5 | Runny |
| Lubricant C | 2.5 | Runny |

TABLE 3-continued

| | Performance | Description |
|---|---|---|
| Lubricant D | 5 | Less sticky than A; stickier than B and C |
| Lubricant E | 5 | Less sticky than A; stickier than B, C and D |
| Lubricant F | 4 | Less sticky than A, C, and D; stickier than B, and C |

Results

With regard to viscosity measures, Lubricant B performed poorly when compared to Lubricant A. Lubricant B was runny, whereas Lubricant A was sticky and maintained an even coat on the gun metal. Lubricant B evaporated quickly when compared to Lubricant A. Slides and bolts operated more smoothly after application of Lubricant A, when compared to application of Lubricant B. After 700 rounds were fired, bolt carriers had a thicker layer of lubrication left behind when Lubricant A was used when compared to Lubricant B. In the present context, a thicker layer being defined as a tangible coat. With regard to Lubricant B, after many rounds comparable products had very little oil left on the gun, if any; whereas Lubricant A remained on the metal and continued to lubricate. The overall performance of Lubricant A was superior when compared to Lubricant B.

Lubricant C and Lubricant B performed similarly. After 700 rounds bolts, barrels and miscellaneous parts remained had improved lubrication with Lubricant A, and Lubricant A performed better in terms of the amount of lubricant remaining on the gun after use.

Lubricant D performed better than Lubricant C and Lubricant B but not as well as Lubricant A. While Lubricant D did not run to the same extent as Lubricant B and Lubricant C, its viscosity was lower than that of Lubricant A. Firearms with large round counts remained better lubricated when using Lubricant A when compared to Lubricant D and were also easier to clean. Overall, Lubricant A performed noticeably better Lubricant D.

Lubricant E performed better than Lubricant D but not as well as Lubricant A. Lubricant E was slightly runnier than Lubricant A. However when applied to test paper for viscosity, the paper absorbed Lubricant E immediately, whereas Lubricant A held a bubble like form for a longer period of time. The viscosity test showed that the viscosity of Lubricant E was lower than Lubricant A, and was absorbed by the paper more rapidly. Overall Lubricant E and Lubricant A performed very well however Lubricant A had a superior performance in terms of viscosity and lubricity.

Lubricant F was runnier than Lubricant E and Lubricant D but not as runny as Lubricant B or Lubricant C. However, Lubricant A outperformed Lubricant F. After a 700 runs Lubricant F was drier in the bolt region, whereas Lubricant A remained wet and continued to lubricate effectively.

Example 3

Lubrication Test 700 rounds of ammunition were rapidly fired through an AR style platform rifle having a mil-spec black anodized bolt. Lubricant A outperformed all other oils being tested. Different tests were done by lubricating the bolt and barrel then cleaning between oils. After 700 rounds, the guns treated with Lubricant B and Lubricant C were dry with multiple malfunctions occurring, such as cartridge feeding malfunctions and sticking bolts resulting from a lack of lubricant. Guns treated with Lubricant D, Lubricant E and Lubricant F had less malfunctions and didn't dry as quickly, however, drying eventually resulted. Lubrication performance, as shown in Table 3, was measured on a scale of 1-10.

TABLE 3

| | Performance | Description |
|---|---|---|
| Lubricant A | 8 | Did not dry and resulted in no malfunctions |
| Lubricant B | 4 | Dried quickly with multiple malfunctions |
| Lubricant C | 4 | Dried quickly with multiple malfunctions |
| Lubricant D | 7 | Dried with few malfunctions |
| Lubricant E | 6 | Dried with few malfunctions |
| Lubricant F | 6 | Dried with few malfunctions |

As shown in Table 3, Lubricant A performed significantly better than comparable products, with regard to measures of lubrication. Lubricant A did not dry after 700 rounds and no gun malfunctions occurred with the use of Lubricant A. After 700 rounds the bolt of the gun remained lubricated and capable of accepting more rounds.

The comparable lubricants B-F dried prior to completion of 700 rounds of firing, to greater or lesser extents. Lubricant B and Lubricant C dried significantly. Lubricant E and Lubricant F were also relatively dry after 7 hundred rounds of firing. Lubricant D performed nearly as well as Lubricant A, with respect to lubrication.

Example 4

Lubricant Performance with Various Types of Guns

Lubricant A was tested with a Remington 870 shotgun, a Beretta A400 semi-automatic weapon, and a Krieghoff K80 and performed well with each, resulting in no malfunctions. Lubricant A was also used with professional USPSA shooter race guns, which are known to experience greater problems related to failure than other guns. The guns that used Lubricant A ran flawlessly. Users of Lubricant A claimed Lubricant A kept the slides lubed, the barrels wet and bullets lubricated without any reported malfunctions.

Lubricant A has a number of unique properties that provide advantages over conventional gun lubricants. For example, Lubricant A has a flash point of at least 430° F., and has a freeze point between −40° F. and −50° F. Lubricant A dries on the exterior, such that it keeps the firearm lint and debris free, a property which is very important to proper gun function. Lubricants that do not have this property can collect large amounts of lint and debris, thereby causing malfunctions.

Lubricant A remains wet and lubricated on the interior moving parts of the firearm where air cannot easily contact the oil, such as areas between the slide of a handgun and the frame, the interior springs, and all metal surfaces. This quality of Lubricant A is important for the life expectancy and function of the firearm, as well as for preventing rust and corrosion.

Lubricant A can be used on any and all metal surfaces including the interior and exterior of the barrel, springs, slides, frames and other components to protect from moisture or rain.

Lubricant A is virtually odorless.

Lubricant A has alternative uses, beyond use as a gun lubricant, for objects including, but not limited to, door hinges, squeaking scope shades, coating the exterior of a scope, zippers, sharpening knives, loosening seized parts, cleaning surface rust, and general lubricant for machinery and the like.

Lubricant A allows for easier gun cleanup following a typical day's use of a gun at a shooting range. Lubricant A effectively prevents carbon build up, such that all that is necessary to clean a gun after a typical shooting session at the range is wiping down the parts of a firearm and reapplying the oil, whereas, with conventional gun lubricants, cleaning after the same amount of shooting typically requires use of a solvent.

This application discloses several numerical ranges. The numerical ranges disclosed are intended to support any range or value within the disclosed numerical ranges even though a precise range limitation is not stated verbatim in the specification because this invention can be practiced throughout the disclosed numerical ranges. It is also to be understood that all numerical values and ranges set forth in this application are necessarily approximate.

The above description is presented to enable a person skilled in the art to make and use the invention, and is provided in the context of a particular application and its requirements. Various modifications to the preferred embodiments will be readily apparent to those skilled in the art, and the generic principles defined herein may be applied to other embodiments and applications without departing from the spirit and scope of the invention. Thus, this invention is not intended to be limited to the embodiments shown, but is to be accorded the widest scope consistent with the principles and features disclosed herein.

What is claimed is:

1. A lubricant comprising:

a first synthetic 10W-30 motor oil having a flash point of approximately 486° F., a pour point of approximately −39° F., a viscosity-kinematic (cSt(mm2/s) at 40° C. of approximately 64.4 and a viscosity-kinematic (cSt (mm2/s) at 100° C. of approximately 10.5;

lubricating oils comprised of petroleum at c>25, hydrotreated bright stock-based;

a second synthetic oil comprised of a base oil of trimethylolpropane complex ester;

wherein the lubricant has a flash point of approximately between 430° F. and 500° F.; and wherein the lubricant has a freeze point between −40° F. and −50° F.

2. The lubricant of claim 1, wherein the lubricant comprises 50 to 70 vol. % the synthetic 10W-30 motor oil;

13.5-28.0 vol. % the lubricating oils comprised of petroleum at c>25, hydrotreated bright stock-based; and 8.0-22.0 vol. % the second synthetic oil.

3. The lubricant of claim 1, wherein the lubricant comprises 70 vol. % the first synthetic 10W-30 motor oil;

18 vol. % the lubricating oils comprised of petroleum at c>25, hydrotreated bright stock-based; and 12 vol. % second synthetic oil.

4. The lubricant of claim 1, wherein the lubricant comprises 65-70 vol. % the first synthetic 10W-30 motor oil;

15-20 vol. % the lubricating oils comprised of petroleum at c>25, hydrotreated bright stock-based; and 10-15 vol. % the second synthetic oil.

5. The lubricant of claim 1, wherein the composition further comprises an oil tackifier.

6. The lubricant of claim 1, wherein the composition further comprises an oil thickener.

7. A process to prepare a lubricant, comprising the steps of:

adding a first synthetic 10W-30 motor oil having a flash point of approximately 486° F., a pour point of approximately −39° F., a viscosity-kinematic (cSt(mm2/s) at 40° C. of approximately 64.4 and a viscosity-kinematic (cSt(mm2/s) at 100° C. of approximately 10.5;

adding lubricating oils comprised of petroleum at c>25, hydrotreated bright stock-based;

adding a second synthetic oil comprised of a base oil of trimethylopropane complex ester having a weight between 80-100%;

thereby forming a lubricant, wherein the lubricant has a flash point of approximately between 430° F. and 500° F.

8. The process of claim 7, wherein the lubricant is comprised of 50 to 70 vol. % of the synthetic 10W-30 motor oil;

13.5-28.0 vol. % of the lubricating oils comprised of petroleum at c>25, hydrotreated bright stock-based; and 8.0-22.0 vol. % the second synthetic oil.

9. The process of claim 7, wherein the lubricant is formed by adding 50 to 70 vol. % of the synthetic 10W-30 motor oil;

13.5-28.0 vol. % of the lubricating oils comprised of petroleum at c>25, hydrotreated bright stock-based; and 8.0-22.0 vol. % the second synthetic oil.

10. The process of claim 7, wherein the second synthetic oil contains at least one detergent.

* * * * *